US011330909B1

(12) United States Patent
Al-Bannai

(10) Patent No.: US 11,330,909 B1
(45) Date of Patent: May 17, 2022

(54) LOVEMAKING APPARATUS FOR THE DISABLED WITH PIVOTING TABLETOP PLATFORM AND PIVOTING WHEELCHAIR SEAT

(71) Applicant: GIFTEDNESS AND CREATIVITY COMPANY, Safat (KW)

(72) Inventor: Abdulrahman M. A. Al-Bannai, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/468,629

(22) Filed: Sep. 7, 2021

(51) Int. Cl.
*A47C 15/00* (2006.01)
*A61G 5/10* (2006.01)

(52) U.S. Cl.
CPC ..... *A47C 15/008* (2013.01); *A61G 5/107* (2013.01); *A61G 5/1067* (2013.01); *A61G 5/1072* (2013.01); *A61G 5/1075* (2013.01); *A61G 2200/10* (2013.01); *A61G 2203/10* (2013.01); *A61G 2203/80* (2013.01)

(58) Field of Classification Search
CPC .. A47C 15/008; A61G 5/1072; A61G 5/1067; A61G 5/107; A61G 5/1075; A61G 2200/10; A61G 2203/10; A61G 2203/80
See application file for complete search history.

(56) References Cited

U.S. PATENT DOCUMENTS 3,703,733 A 11/1972 McLaughlin
4,987,620 A * 1/1991 Sharon ..... A61G 5/006 5/600
5,555,582 A * 9/1996 Jerideau ..... A61G 5/006 5/600
5,875,779 A 3/1999 Fuhrman et al.
5,996,140 A 12/1999 Kitamura
6,272,702 B1 * 8/2001 Uchida ..... A61G 5/006 5/600

(Continued)

FOREIGN PATENT DOCUMENTS

JP 2003334228 A 11/2003
JP 2005305084 A 11/2005

OTHER PUBLICATIONS

"Tuffcare Commode Shower Wheelchair S970",Tuffcare, printed from www.home-med-equip.com/catalog/tuffcare-commode-shower-wheelchalr-s970.html on Sep. 7, 2021, 7 pages.

*Primary Examiner* — Milton Nelson, Jr.
(74) *Attorney, Agent, or Firm* — Nath, Goldberg & Meyer; Richard C. Litman

(57) ABSTRACT

The lovemaking apparatus includes a table having a slidable platform pivotally mounted in a U-shaped opening defined in an end of the table and a wheelchair having a chair assembly that is pivotally mounted on a wheelchair frame. The wheelchair may be rolled to the platform end of the table so that the seat and leg rest portion of the chair assembly is below the free end of the platform, linear actuators may be actuated to pivot the platform at an angle using switches mounted at the platform end of the table, and the platform may be slid downward towards the seat of the chair assembly of the wheelchair. Linear actuators mounted on the wheelchair frame may be actuated to tilt the back of the chair assembly rearward and raise the seat of the chair assembly upward to position partners for sexual relations.

11 Claims, 4 Drawing Sheets

(56) References Cited

U.S. PATENT DOCUMENTS

| | | | | |
|---|---|---|---|---|
| 6,384,434 | B1 | 4/2002 | Reid | |
| 6,698,431 | B1 | 3/2004 | Harris et al. | |
| 7,431,036 | B2 | 10/2008 | Al-Bannai | |
| 9,375,376 | B2 * | 6/2016 | Latney | A61G 5/1067 |
| 9,510,984 | B1 | 12/2016 | MacKenzie | |
| 10,213,025 | B1 | 2/2019 | Ai-Bannai | |
| 2013/0074256 | A1 * | 3/2013 | Tsukada | A61G 7/165<br>5/81.1 R |
| 2014/0191541 | A1 * | 7/2014 | Ohta | A61G 5/128<br>297/118 |

* cited by examiner

LOVEMAKING APPARATUS FOR THE DISABLED WITH PIVOTING TABLETOP PLATFORM AND PIVOTING WHEELCHAIR SEAT

BACKGROUND

1. Field

The disclosure of the present patent application relates to furnishings for the disabled, and particularly to a lovemaking apparatus that has features for assisting a disabled person to have marital relations with a consenting adult.

2. Description of the Related Art

Sexual intimacy and performance of the marital act are an integral part of the marital relationship, helping husband and wife to preserve closeness in their dealings with each other. However, sometimes disease or injury makes it difficult or painful for a disabled person to assume or maintain the positions or movements required to engage in sexual intercourse on a conventional bed. Men with back and spinal problems, infirm persons, obese persons, and other disabled persons may need an apparatus for facilitating sexual relations.

My prior patents, U.S. Pat. No. 7,431,036, issued Oct. 7, 2008 and U.S. Pat. No. 10,213,025, issued Feb. 26, 2019, both described lovemaking apparatus that represented an advance in the state of the art at the time designed to assist disabled persons to obtain fulfillment in this often overlooked area of their life. Nevertheless, both of these apparatus entailed some inconvenience, physical exertion, and perhaps the assistance of third parties in preparation for an episode of lovemaking, since both apparatus required that the disabled person move from his wheelchair onto the apparatus.

A lovemaking apparatus that imposes as little adjustment as possible in the disabled person's normal lifestyle would be desirable. Thus, a lovemaking apparatus solving the aforementioned problems is desired.

SUMMARY

The lovemaking apparatus includes a table having a slidable platform pivotally mounted in a U-shaped opening defined in an end of the table and a wheelchair having a chair assembly that is pivotally mounted on a wheelchair frame. The wheelchair may be rolled to the platform end of the table so that the seat and leg rest portion of the chair assembly is below the free end of the platform, linear actuators may be actuated to pivot the platform at an angle using switches mounted at the platform end of the table, and the platform may be slid downward towards the seat of the chair assembly of the wheelchair. Linear actuators mounted on the wheelchair frame may be actuated to tilt the back of the chair assembly rearward and raise the seat of the chair assembly upward to position partners for sexual relations.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

The lovemaking apparatus includes a table having a slidable platform pivotally mounted in a U-shaped opening defined in an end of the table and a wheelchair having a chair assembly that is pivotally mounted on a wheelchair frame. The wheelchair may be rolled to the platform end of the table so that the seat and leg rest portion of the chair assembly is below the free end of the platform, linear actuators may be actuated to pivot the platform at an angle using switches mounted at the platform end of the table, and the platform may be slid downward towards the seat of the chair assembly of the wheelchair. Linear actuators mounted on the wheelchair frame may be actuated to tilt the back of the chair assembly rearward and raise the seat of the chair assembly upward to position partners for sexual relations.

Figure 1:
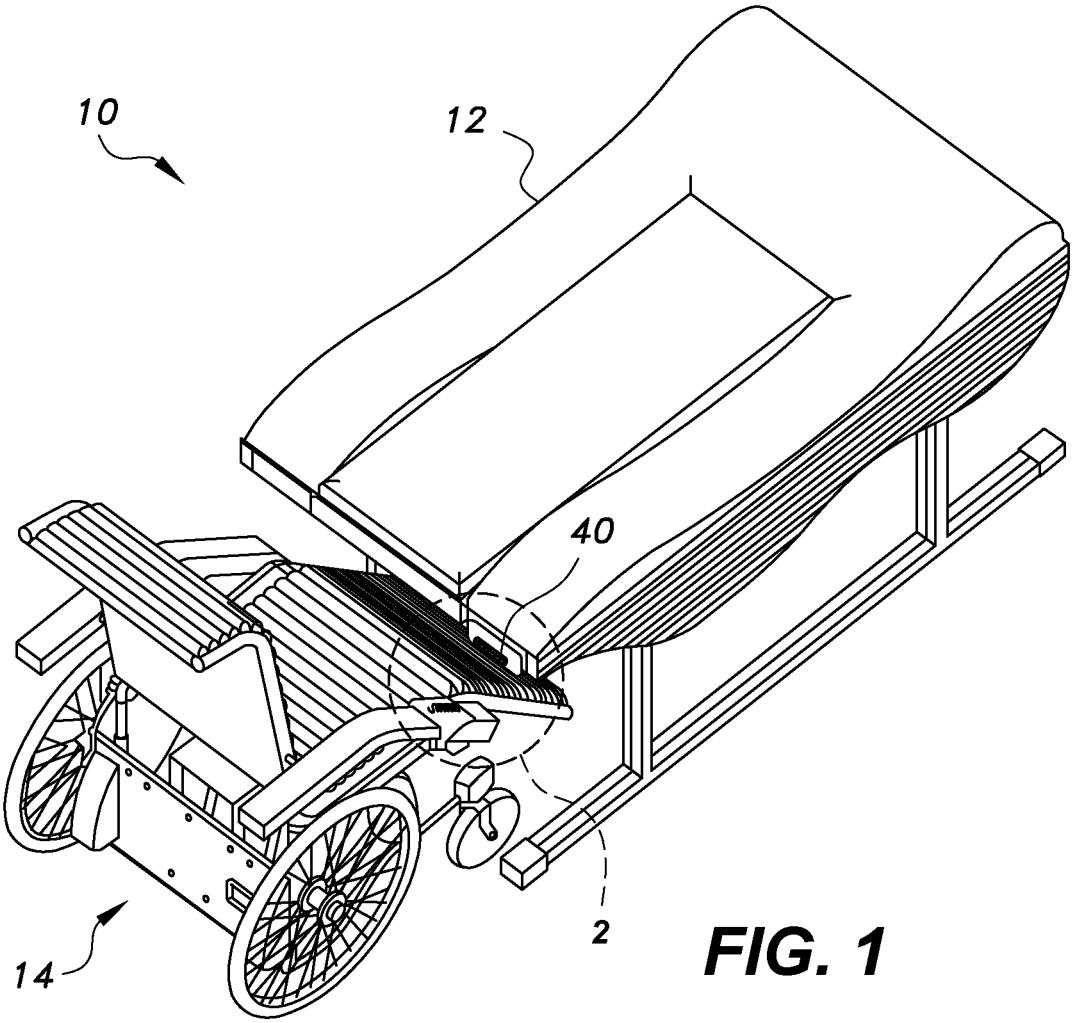
FIG. 1 is a perspective view of the lovemaking apparatus.
Figure 2:
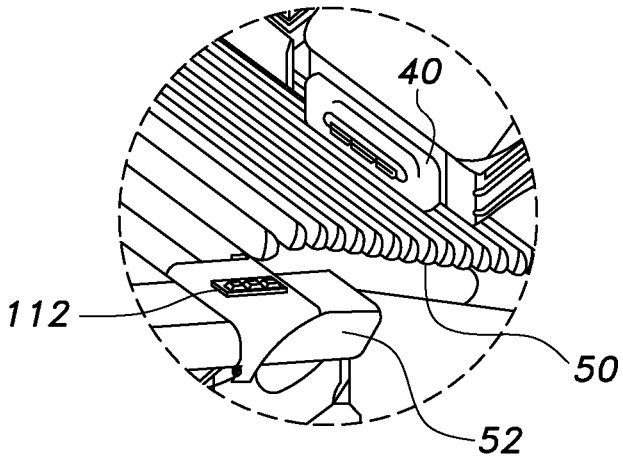
FIG. 2 is detailed perspective view of area 2 of FIG. 1.
Figure 3:
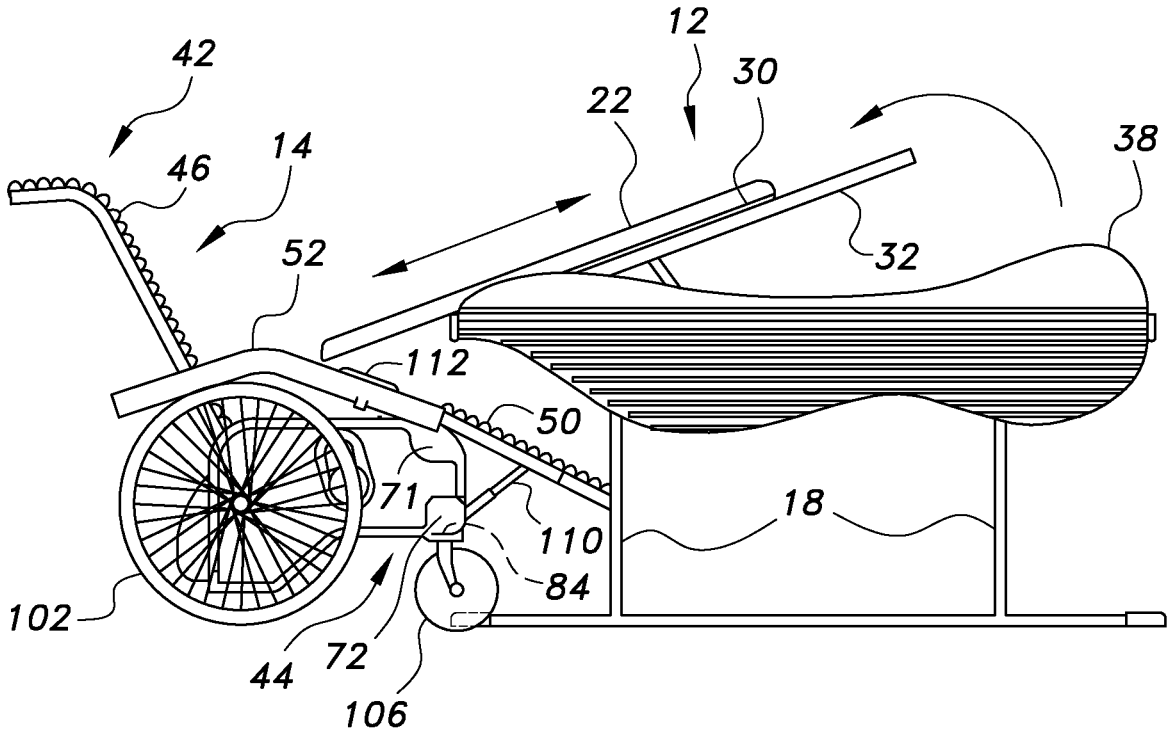
FIG. 3 is a side view of the lovemaking apparatus, showing the chair assembly of the wheelchair raised above the frame and tilted backward and the platform of the table pivoted at an angle and slid downward towards the wheelchair.
Figure 5:
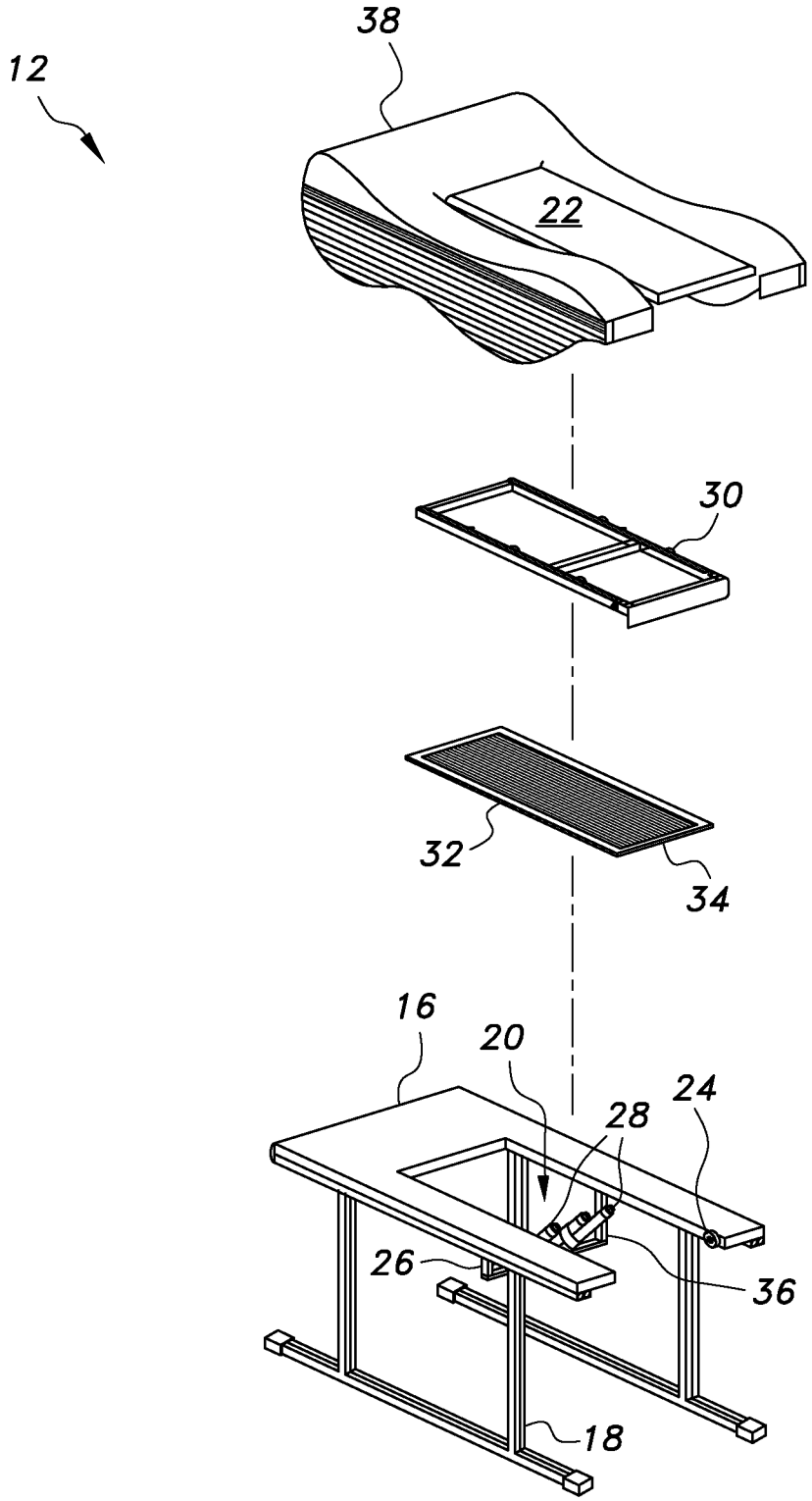
FIG. 5 is an exploded perspective view of the table of the lovemaking apparatus.

As shown in FIG. 1, the lovemaking apparatus 10 includes a table 12 and a wheelchair 14. The table 12 is used to support the female partner during lovemaking. As shown in FIG. 5, the table 12 includes a generally rectangular tabletop 16 supported on legs 18. The tabletop 16 has a U-shaped opening 20 defined in one end thereof. A platform 22 dimensioned and configured to support the head and torso of the female partner is pivotally mounted in the U-shaped opening 20 on bearings 24 adjacent the end of the table 12. A U-shaped support frame 26 depends from the tabletop 16 and extends below the tabletop 16 across the U-shaped opening 20. A plurality of linear actuators 28, preferably electrical linear actuators, are mounted on the U-shaped support frame 26. The platform 22 is mounted on a slider frame 30, which, in turn, is slidably mounted on a slide plate 32 having a plurality of rows of roller balls or bearings 34 for reducing friction. The pistons 36 of the linear actuators 28 are attached to opposite sides of the slide plate 32 so that when the motors of the linear actuators 28 are switched on, the linear actuators 28 lift the medial end of the platform 22, which pivots on the bearings 24 adjacent the end of the table 12 to lift the woman's torso. A plurality of switches 40, which may be push buttons, rocker switches, or other suitable switches, may be mounted at the end of the able 12 to extend and retract the linear actuators 28, as shown in FIGS. 1 and 2. The disabled man in the wheelchair 13 may then manually slide the platform 22 down towards the seat of the wheelchair 14 to position the couple for sexual relations, as shown in FIG. 3. The table may have upholstery 38 with side skirts to conceal the operating mechanism of the platform 22.

Figure 4:
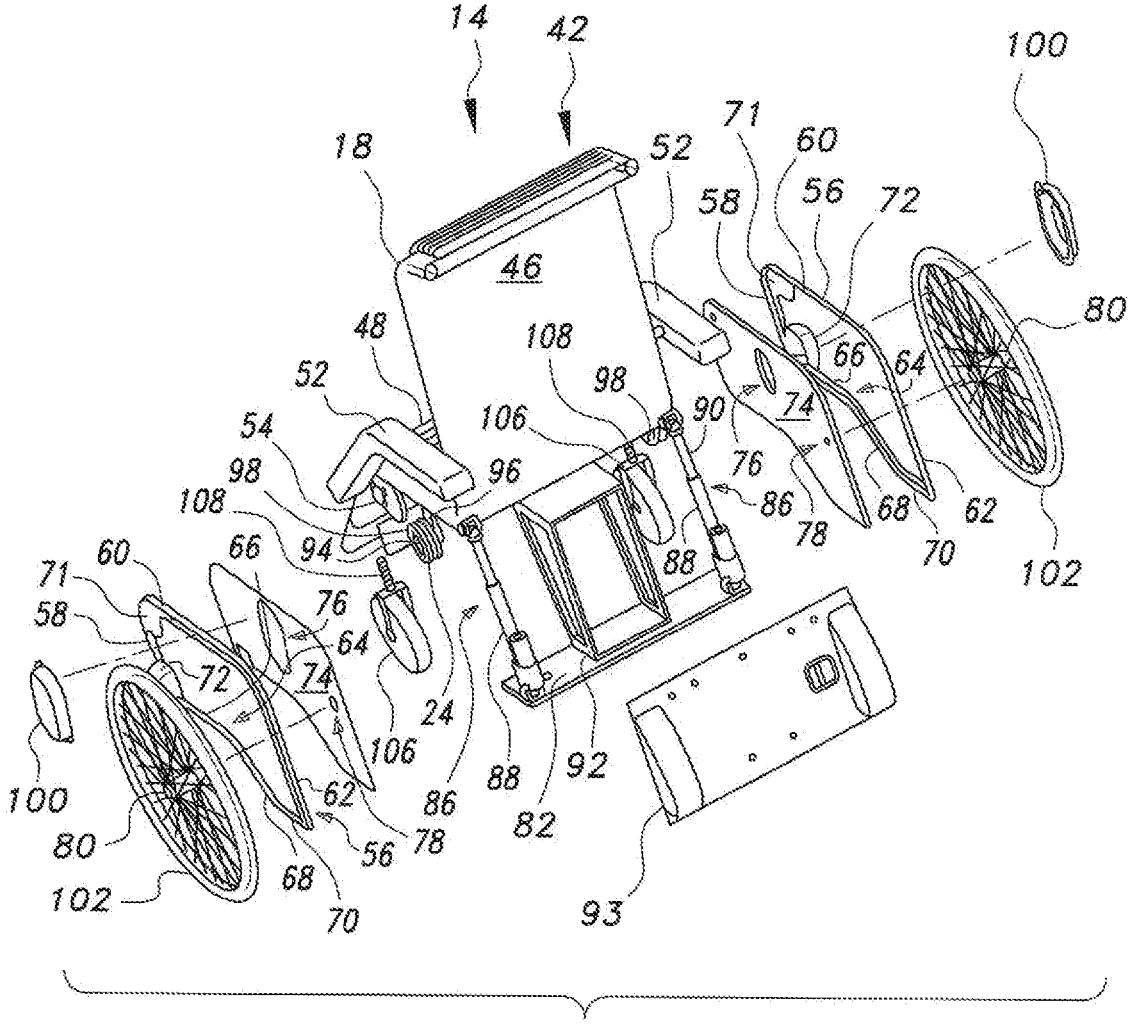
FIG. 4 is an exploded perspective view of the wheelchair of the lovemaking apparatus.

As shown in FIGS. 3 and 4, the wheelchair 14 has a chair assembly 42 mounted on a wheelchair frame 44. The chair assembly 42 includes a chair back 46, a chair seat 48, and a leg rest 50 rigidly attached in an integral assembly. The chair assembly 42 also includes arm rests 52 attached to opposite sides of the chair assembly at a mid-portion of the chair back 46 and at an upper portion of the leg rest 50. In some embodiments, the arm rests 52 may be configured to support the woman's legs when the platform 22 is slid downward to approach the seat 48 of the wheelchair 14. The chair assembly 42 may have bearings 54 extending laterally from the junction of the chair seat 48 and the leg rest 50 for pivotally mounting the chair assembly 42 to the wheelchair frame 44.

As shown in FIG. 4, the wheelchair frame 44 has opposed tubular side frame members 56, each of the side members 56 having a front vertical post 58, a top rail 60 extending rearward from the front post 58, a rear vertical post 62 extending downward from the top rail 60 parallel to the front post 58, the rear post 62 being longer than the front post 58, and a bottom rail 64, the bottom rail 64 having a front portion 66 extending rearward from the front post 58 parallel to the top rail, an angled portion 68 sloping downward from the front portion 66, and a rear portion 70 extending rearward between the angled portion 68 and the rear post 62 parallel to the top rail 60, the side frame members 56 defining a generally rectangular area merged with a downwardly extending rear trapezoidal area. The side frame members 56 each have a plate 71 in the top front corner defining a socket receiving the bearings 54 extending laterally from the chair assembly 42 and a front axle housing 72 mounted in the lower front corner.

A side panel 74 having the same shape as the side frame member 56 is attached to the side frame member 56 on both sides of the wheelchair frame 44. Each of the side panels 74 has a slot 76 extending vertically and canted rearward defined therein. Each of the side panels 74 also has an axle bore 78 defined therein for mounting a laterally extending rear axle. 80. A bottom plate 82 extends laterally between the rear portions 70 of the bottom rails 64, spacing the side frame members 56 apart. A similar front plate 84 extends laterally between the front portions 66 of the bottom rails 64. A pair of linear actuators 86, preferably electrical linear actuators, have their base cylinders 88 and motors mounted on the bottom plate 82 and their pistons 90 attached to devises mounted to the chair assembly 42 at the junction between the chair back 46 and the chair seat 48 on opposite sides of the wheelchair 14. A support stand 92 may also be attached to the bottom plate 82 to support the chair seat 48 in some positions of the chair assembly 42. A rear cover 93 may conceal and protect the linear actuators 86.

A trunnion pin 94 mounted on a mounting lug 96 extending below the chair seat 48 extends laterally from each side of the chair assembly 42. A roller wheel 98 is attached to the free end of each of the trunnion pins 94, the roller wheels 98 being mounted in the slots 76 defined in the side panels 74. Each of the roller wheels 98 may have a groove defined in their outer rim for using the edges of the slots 76 as a guide. A small cover 100 may be mounted over the slots 76 and roller wheels 98 to protect the mechanism.

The wheelchair 14 may be supported by rear drive wheels 102 mounted on rear axles 80 that extend through the side panels 74 and the hubs of the rear wheels 102, and by front caster or steering wheels 106 having vertical axles 108 that may engage gears or steering mechanisms in the axle housings 72. Optionally, a telescoping support strut 110 may extend between the front plate 84 of the wheelchair frame 44 and the leg rest 50. A plurality of switches 112 may be mounted on the arm rest 52 for controlling extension and contraction of the linear actuators 86.

In use, the woman will lie on the table 12 with her back resting on the platform 22. During normal daily activities, the pistons 92 of the wheelchair's linear actuators 88 will be extended, so that the chair back 46 is erect, the seat 48 is level, and the leg rest 50 is lowered. The roller wheels 98 at the free ends of the trunnion pins 94 will be at the top end of the slots 76 in the side panels 74, which limit how far the seat 48 can be raised. The disabled man positions the wheelchair 14 at the platform end of the table with the leg rest 50 and the portion of the seat 48 supporting his upper legs beneath the end of the table 12. Using the switches 112 on the arm rest 52, the man retracts the pistons 92, lowering the back end of the wheelchair seat 48 below the top rails 60 of the wheelchair frame 44 while tilting the chair back 48 rearward and the front portion of the chair seat 48 and the leg rest 50 upward toward the table. The roller wheels 98 at the free ends of the trunnion pins 94 will be at the bottom end of the slots 76 in the side panels 74, which limit how far the seat 48 can be lowered and how far backward and downward the chair back 46 can be tilted. The man actuates the switches 40 on the table 12 to tilt the platform 22, raising the medial end of the platform 22 and lowering the free end, and grasps the platform 22 with his hands to lower the platform 22 towards the chair seat 48 until the couple are properly positioned for sexual relations.

It is to be understood that the lovemaking apparatus is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A lovemaking apparatus, comprising:

a table having:

a tabletop;

a plurality of legs, the tabletop being supported on the legs, the tabletop having a platform end defining a U-shaped opening;

a platform pivotally mounted in the U-shaped opening at the platform end;

at least one table linear actuator mounted on the table, the linear actuator having a piston attached to the platform, the linear actuator being switchable between a retracted position in which the platform is flush with the tabletop and an extended position in which the piston raises the platform medially to pivot the platform downward at an angle toward the platform end; and at least one switch mounted at the platform end of the table for switching the table linear actuator between the retracted position and the extended position; and a wheelchair having:

a chair assembly including a chair seat having a front end and a back end, a chair back extending upward from the back end of the chair seat, a leg rest extending downward from the front end of the chair seat, and a pair of arm rests on opposing sides of the chair seat, respectively, the chair seat, chair back, leg rest, and arm rests being a rigid, one-piece assembly;

a wheelchair frame having a pair of opposed tubular side frame members, a pair of side panels attached to the tubular side frame members, respectively, and front and rear bottom plates extending between the tubular side frame members, the chair assembly being pivotally mounted on the wheelchair frame;

rear drive wheels and front caster wheels mounted on the side panels, and tubular side frame members, respectively;

at least one wheelchair linear actuator having a cylinder attached to the rear bottom plate and a piston extendable from the cylinder, the piston being attached to the chair assembly at a junction between the chair back and the back end of the chair seat, the at least one wheelchair linear actuator having an extended position in which the chair back is substantially erect, the chair seat is substantially level, and the leg rest extends downward, and a retracted position in which the piston retracts into the cylinder to pull the back end of the chair seat downward, tilting the chair back rearward and tilting the leg rest upward; and at least one switch mounted on one of the arm rests for switching the wheelchair linear actuator between the extended position and the retracted position.

2. The lovemaking apparatus according to claim 1, wherein said side panels each have a rearward canted slot defined therein, the lovemaking apparatus further comprising:

a pair of trunnion pins mounted beneath the chair seat, the trunnion pins extending laterally from opposite sides of the chair seat, respectively, each of the trunnion pins having a free end; and a pair of roller wheels, each of the trunnion pins having one of the roller wheels rotatably mounted on the free end thereof, the roller wheels extending into the slots in the side panels, respectively, and being constrained to roll in the slots, the chair assembly pivoting on the trunnion pins, raising and lowering of the chair seat by the at least one wheelchair linear actuator and tilting of the chair back and leg rest being limited by the slots in the side panels.

3. The lovemaking apparatus according to claim 1, wherein each said at least one table linear actuator and each said at least one wheelchair linear actuator comprises an electrical linear actuator.

4. The lovemaking apparatus according to claim 1, wherein said table further comprises a slide assembly, said platform being mounted cm the slide assembly, whereby said platform is both pivotally and slidably mounted on said table.

5. The lovemaking apparatus according to claim 1, wherein each said tubular side frame member comprises:

a front vertical post;

a top rail extending rearward from the front post;

a rear vertical post extending downward from the top rail parallel to the front post, the rear post being longer than the front post; and a bottom rail, the bottom rail having a front portion extending rearward from the front post parallel to the top rail, an angled portion sloping downward from the front portion, and a rear portion extending rearward between the angled portion and the rear post parallel to the top rail, the side frame members defining a generally rectangular area merged with a downwardly extending rear trapezoidal area.

6. The lovemaking apparatus according to claim 5, wherein;

the front vertical post and the top rail of each said tubular side frame member defines a corresponding top front corner, each said tubular side frame member having a plate defining a socket mounted in the top front corner; and said chair assembly further comprises bearings extending laterally from the junction of the chair seat and the leg rest on opposite sides of said chair assembly, the bearings engaging the sockets in the corresponding top front corners of said tubular side frame member, pivotally attaching said chair assembly to said wheelchair frame at the front end of the chair seat.

7. The lovemaking apparatus according to claim 5, wherein:

the front vertical post and the front portion of the bottom rail of each said tubular side frame member defines a corresponding lower front corner, each said tubular side flame member having a front axle housing mounted in the corresponding lower front corner; and each said front caster wheel has a vertical axle extending into the corresponding front axle housing.

8. The lovemaking apparatus according to claim 5, wherein said bottom plate extends laterally between the rear portions of the bottom rails of said tubular side frame members.

9. The lovemaking apparatus according to claim 5, wherein said front plate extends laterally between the front portions of the bottom rails of said tubular side frame members.

10. The lovemaking apparatus according to claim 1, further comprising at least one telescoping strut extending between said front plate of said wheelchair frame and said leg rest.

11. The lovemaking apparatus according to claim 1, further comprising a support stand attached to said bottom plate.

* * * * *